US007354023B1

(12) United States Patent
Wappler

(10) Patent No.: US 7,354,023 B1
(45) Date of Patent: Apr. 8, 2008

(54) TOOL AND PART HOLDING TRAY

(76) Inventor: Michael J. Wappler, 2044 Calumet Dr., Sheboygan, WI (US) 53081

( * ) Notice: Subject to any disclaimer, the term of this patent is extended or adjusted under 35 U.S.C. 154(b) by 426 days.

(21) Appl. No.: 11/073,372

(22) Filed: Mar. 7, 2005

(51) Int. Cl.
*A47G 1/17* (2006.01)

(52) U.S. Cl. ..... 248/206.5; 248/309.1; 248/309.4; 248/304; 248/339

(58) Field of Classification Search ..... 248/206.5, 248/300, 304, 309.1, 309.4, 339; 206/350, 206/818, 373
See application file for complete search history.

(56) References Cited

U.S. PATENT DOCUMENTS 2,958,566 A * 11/1960 Buck ..... 108/44
3,186,673 A * 6/1965 Olson ..... 248/309.4
D283,657 S 5/1986 Chaplin et al.
5,078,281 A 1/1992 Johnson
5,111,342 A * 5/1992 Quesada ..... 359/872
5,221,006 A 6/1993 Plumlee et al.
5,331,904 A 7/1994 DiSimone et al.
5,699,910 A 12/1997 Kubat
5,803,422 A 9/1998 Buehler
6,041,717 A 3/2000 Kubat

* cited by examiner

*Primary Examiner*—Amy J. Sterling

(57) ABSTRACT

A tool and part holding tray includes a panel that has a top side, a bottom side and a peripheral edge. The panel has a generally rectangular shape such that the peripheral edge includes a front edge, a back edge, a first side edge and a second side edge. A peripheral wall is attached to the peripheral edge and extends upwardly away therefrom. A plurality of magnets is attached to the bottom side of the panel. Each of a pair of brackets is attached to the panel. The brackets are spaced from each other. Each of a pair of couplers is removably attached to one of the brackets and each is adapted for selectively coupling the brackets to a support beam.

9 Claims, 5 Drawing Sheets

TOOL AND PART HOLDING TRAY

BACKGROUND OF THE INVENTION

1. Field of the Invention

The present invention relates to tool tray devices and more particularly pertains to a new tool tray device for holding tools and parts to a support beam of a vehicle lifting assembly to ensure convenient positioning of the tools and parts relative to a vehicle being worked on.

2. Description of the Prior Art

The use of tool tray devices is known in the prior art. U.S. Pat. No 5,803,422 describes a device for holding tools and the like on a vehicle lift system. Another type of tool tray device is U.S. Pat. No. 5,699,910 which is adapted for being attached to an uneven surface. Yet another such device is found in U.S. Pat. No. 5,078,281 which utilizes a magnet swingable support for easy adjustment of the tray.

While these devices fulfill their respective, particular objectives and requirements, the need remains for a device that includes magnets positioned on a tray for aiding in the prevention of movement and loss of object positioned on the tray. Additionally, the device should include adjustable means for selectively attaching the tray to vehicle hydraulic lift systems. This will allow for easy retrofitting of the tray to existing and future lift systems without concern of support beam configurations and sizes.

SUMMARY OF THE INVENTION

The present invention meets the needs presented above by generally comprising a panel that has a top side, a bottom side and a peripheral edge. The panel has a generally rectangular shape such that the peripheral edge includes a front edge, a back edge, a first side edge and a second side edge. A peripheral wall is attached to the peripheral edge and extends upwardly away therefrom. A plurality of magnets is attached to the bottom side of the panel. Each of a pair of brackets is attached to the panel. The brackets are spaced from each other. Each of a pair of couplers is removably attached to one of the brackets and each is adapted for selectively coupling the brackets to a support beam.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
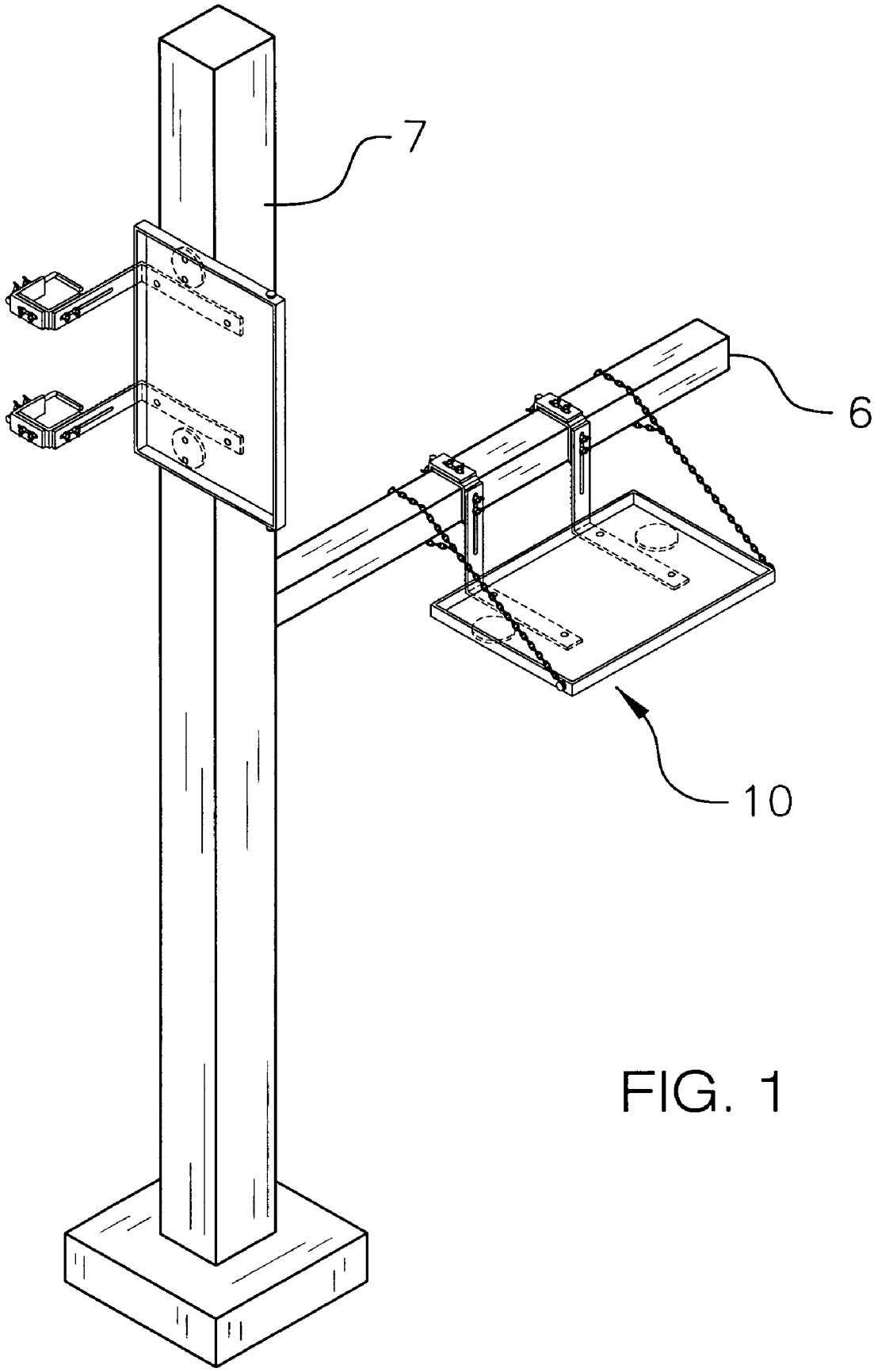
FIG. 1 is a perspective in-use view of a tool and part holding tray according to the present invention.
Figure 2:
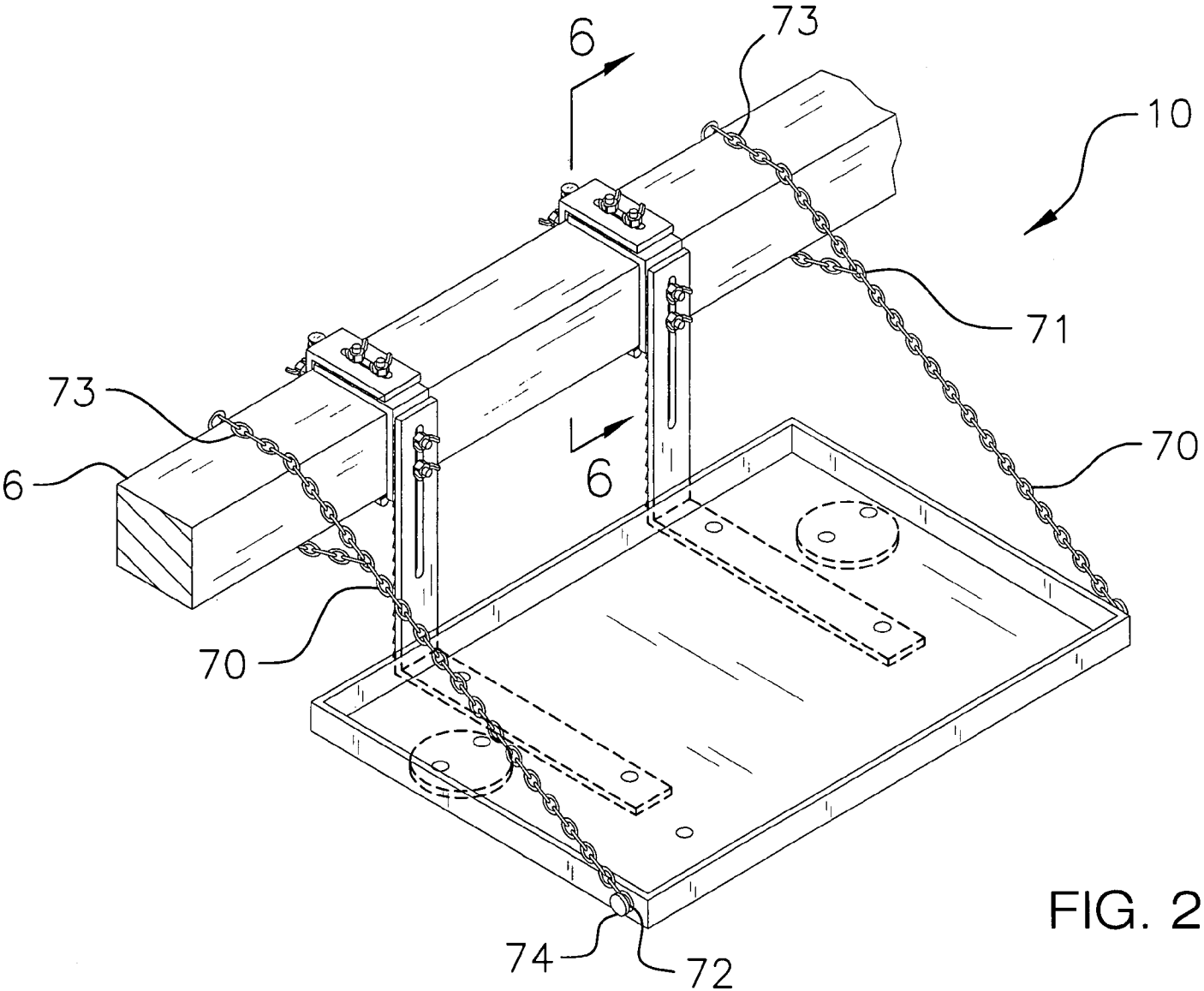
FIG. 2 is a perspective in-use view of the present invention.
Figure 3:
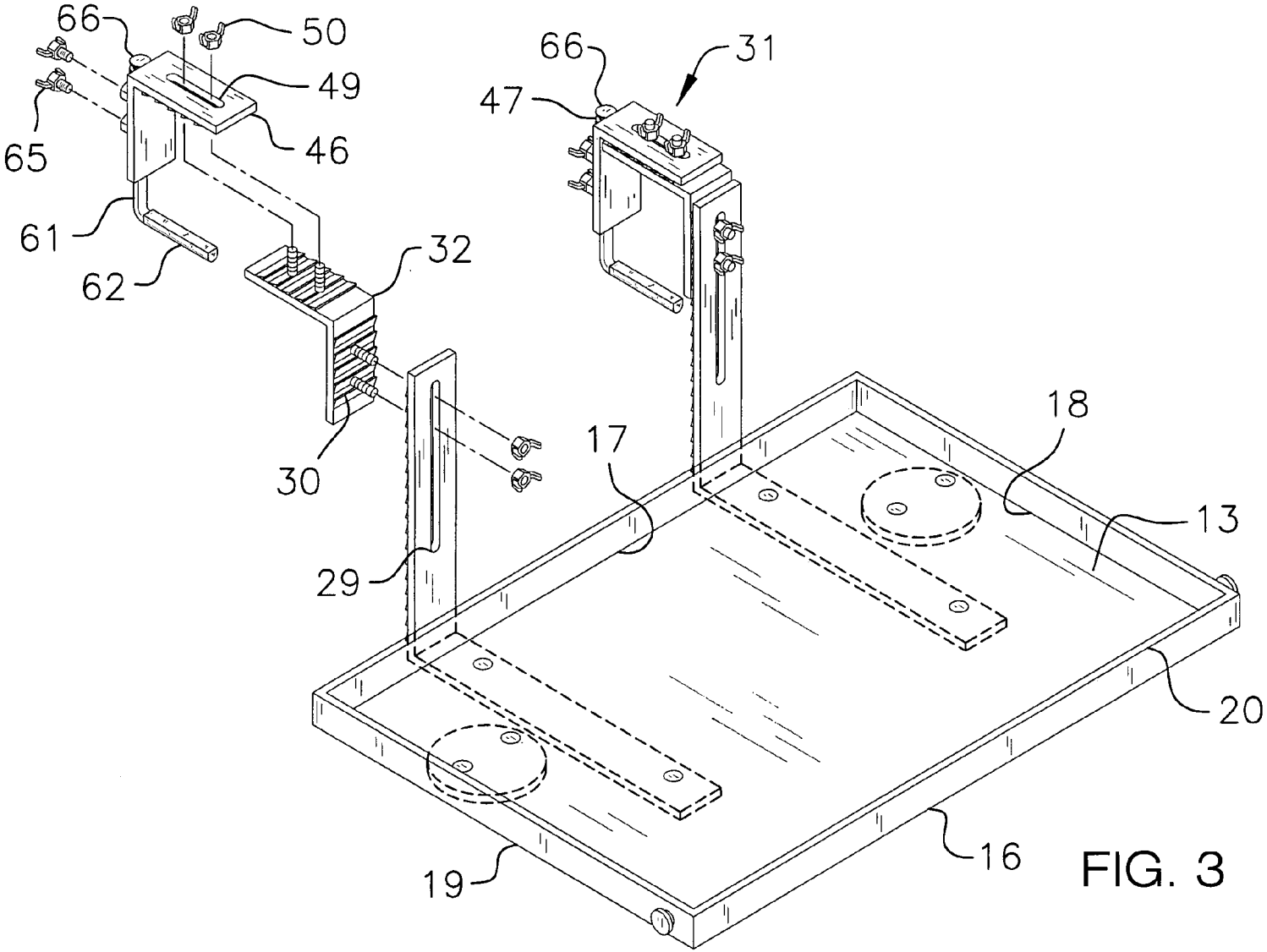
FIG. 3 is a perspective view of the present invention.
Figure 4:
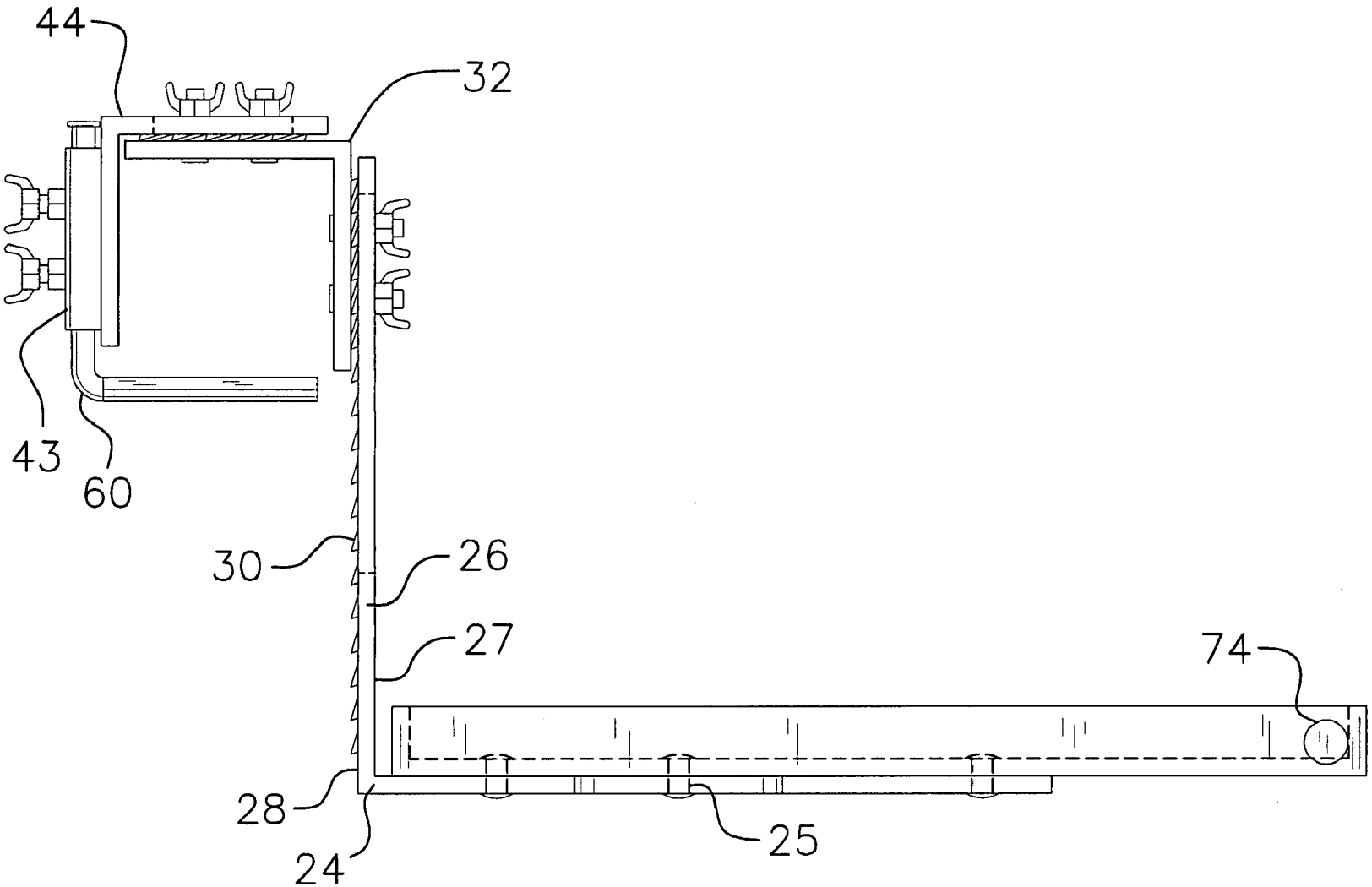
FIG. 4 is a side view of the present invention.
Figure 5:
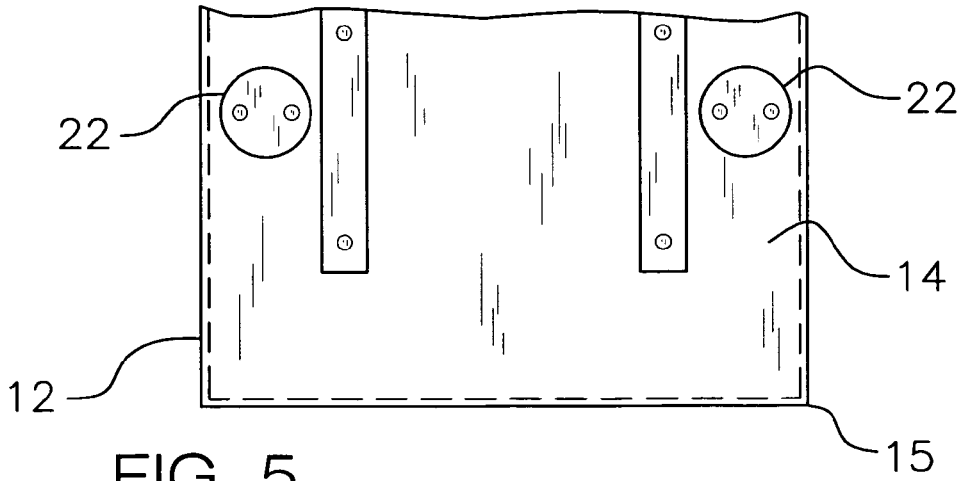
FIG. 5 is a bottom view of the tray of the present invention.
Figure 6:
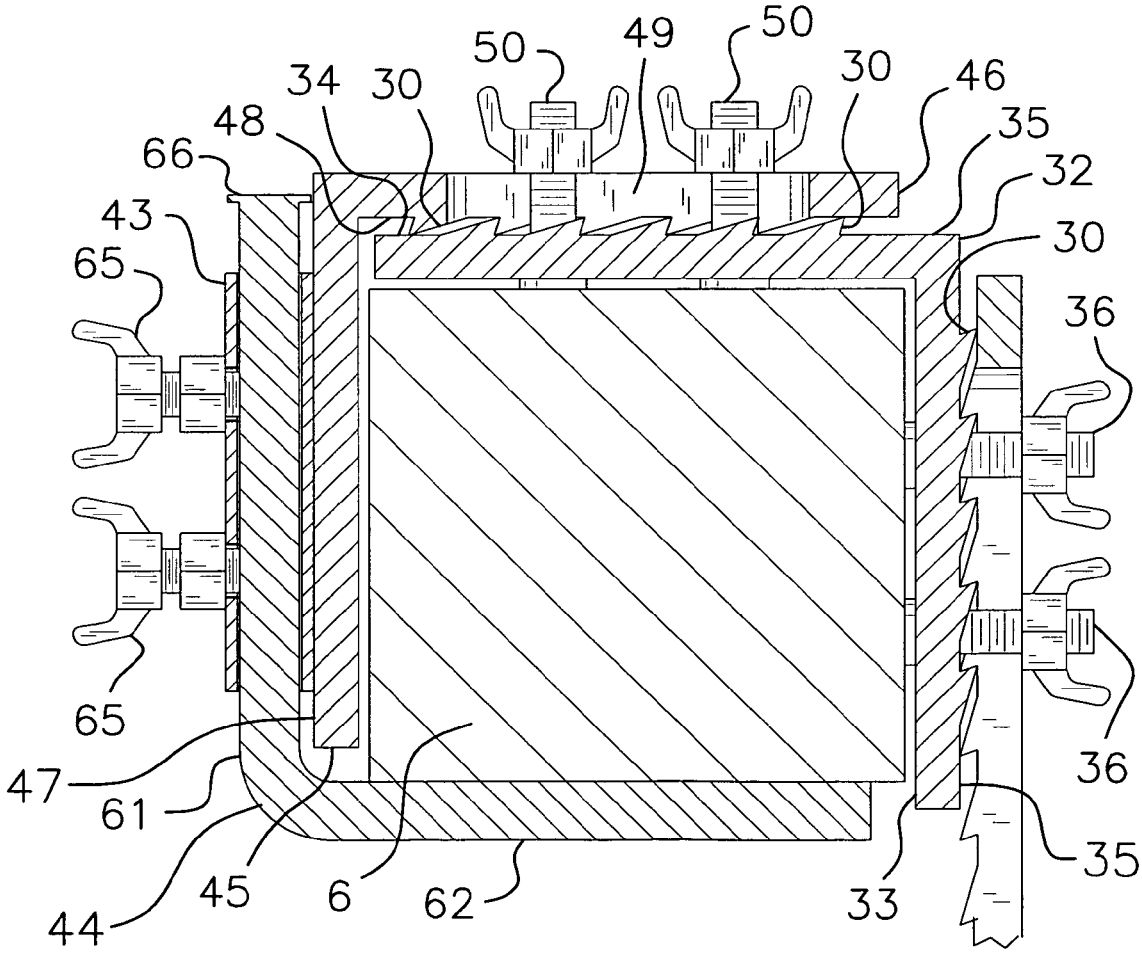
FIG. 6 is a cross-sectional view taken along line 6-6 of FIG. 2 of the present invention.

With reference now to the drawings, and in particular to FIGS. 1 through 6 thereof, a new tool tray device embodying the principles and concepts of the present invention and generally designated by the reference numeral 10 will be described.

As best illustrated in FIGS. 1 through 6, the tool and part holding tray 10 generally comprises a panel 12 that has a top side 13, a bottom side 14 and a peripheral edge 15. The panel 12 has a generally rectangular shape such that the peripheral edge 15 includes a front edge 16, a back edge 17, a first side edge 18 and a second side edge 19. A peripheral wall 20 is attached to the peripheral edge 15 and extends upwardly away therefrom. The panel 12 may be constructed of any rigid material including plastics and metal.

Each of a plurality of magnets 22 is attached to the bottom side 14 of the panel 12. The magnets 22 are positioned nearer generally between the front 16 and back 17 edges and are preferably spaced from each other. The plurality of magnets 22 preferably includes two magnets.

Each of a pair of brackets 24 is attached to the panel 12. The brackets 24 are spaced from each other. The brackets 24 each include a horizontal arm 25 and a vertical arm 26. The horizontal arms 25 are attached to the bottom side 14 and extend from the back edge 17 to the front edge 16. The vertical arms 26 each extend upwardly from the back edge 17. Each of the vertical arms 26 has a forward side 27 facing the panel 12 and a rearward side 28. The vertical arms 26 each have an elongated vertical slot 29 extending therethrough. The rearward sides 28 each have a plurality of teeth 30 thereon.

Each of a pair of couplers 31 is removably attached to one of the vertical arms 26 and is adapted for selectively coupling the vertical arms 26 to a support beam 6. Each of the couplers 31 includes a first L-shaped member 32, a second L-shaped member 44 and a third L-shaped member 60. The first L-shaped member 32 has a first arm 33 and a second arm 34. Each of the first 33 and second 34 arms has an outer surface 35 that has a plurality of teeth 30 thereon. The outer surface 35 of the first arm 33 is selectively positionable against the rearward side 28 of one of the vertical arms 26. A first pair of fasteners 36 extends through the first arm 33 and is selectively extendable through the vertical slot 29. The second arm 34 is selectively positionable over the support beam 6.

The second L-shaped member 44 has a first plate 45 and a second plate 46. The first plate 45 have an outer surface 47 that has a cylinder 43 attached thereto and the second plate 46 has an inner surface 48 having a plurality of teeth 30 thereon. The second plate 45 has an elongated aperture 49 therein. The inner surface 48 of the second plate 46 is selectively positionable against the outer surface 35 of the second arm 34. A second pair of fasteners 50 extends through the second arm 34 and is selectively extendable through the aperture 49 in second plate 46.

The third L-shaped member 60 has a first rod 61 and a second rod 62. The first rod 61 has a cylindrical shape and is positioned in and rotatably coupled to the cylinder 43. The first rod 61 has free end 66 forming a head having a diameter greater than the cylinder 43. A third pair of fasteners 65 extends through the cylinder 43 and is selectively abuttable against the first rod 61 to secure the first rod in place. The first rod 61 has a longer length than the cylinder 43 to adjust the distance between the second rod 62 and the second arm 34. The second rod 62 is selectively extended under the support beam 6. It should be understood that though in each case it is preferred that pairs of fasteners 36, 50, 65 are utilized, only one fastener may be used in the place of two fasteners. The teeth 30 on the couplers 31 and brackets 24 help to retain the relative positioning of the couplers 31 and the brackets 24 while the slots 29, apertures 49 and cylinder 43 allow for adjustments in sizes with respect to the support beam 6.

A pair of tethers 70 is also provided for increasing the amount of weight that may be supported on the tray, or panel 12. Each of the tethers 70 is elongated and has a first end 71 and a second end 72. Each of a pair of loops 73 is attached to one of the first ends 71. The second ends 72 are each removably attached to nubs 74 placed on the peripheral wall 20. The second ends 72 are positionable adjacent to one of the first 18 and second 19 side edges.

In use, the couplers 31 are attached to the beam 6 so that that the tray 12 is supported on the beam 6. Tools and parts may be positioned on the tray 12 so that they are conveniently positioned for use. The magnets 22 prevent parts from moving around on the tray 12 and retain them in selected positions on the tray 12. The magnets 22 may also be used for storing the tray 10 as shown by its being placed vertically on a vertical support 7 as shown in FIG. 1.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tray assembly for releasably mounting on a support beam, said assembly comprising:

a panel having a top side, a bottom side and a peripheral edge, said panel having a generally rectangular shape such that said peripheral edge includes a front edge, a back edge, a first side edge and a second side edge, a peripheral wall being attached to said peripheral edge and extending upwardly away therefrom;

a plurality of magnets being attached to said bottom side of said panel;

a pair of brackets, each of said brackets being attached to said panel and being spaced from each other, each of said brackets being attached to said panel and being spaced from each other, each of said brackets including a horizontal arm attached to said bottom side and extending from said back edge to said front edge, each of said brackets including a vertical arm being attached to an associated one of said horizontal arms, each of said vertical arms extending upwardly from said back edge, each of said vertical arms having a forward side facing said panel and a rearward side, each of said vertical arms having an elongated vertical slot extending therethrough, wherein said couplers may be selectively moved along said vertical slots; and a pair of couplers, each of said couplers being removably attached to one of said brackets and being adapted for selectively coupling said brackets to the support beam.

2. The assembly according to claim 1, wherein each of said magnets is positioned nearer to said front edge than said back edge.

3. The assembly according to claim 2, wherein said magnets are spaced from each other.

4. The assembly according to claim 1, wherein each of said rearward sides has a plurality of teeth thereon.

5. The assembly according to claim 1, wherein each of said couplers includes:

a first L-shaped member having a first arm and a second arm, said outer surface of said first arm being selectively positionable against one of said brackets, at least one fastener extending through said first arm and being selectively extendable through said vertical slot, wherein said second arm is selectively positionable over the support beam;

a second L-shaped member having a first plate and a second plate, said second plate having an inner surface having teeth thereon, said second plate having an elongated aperture therein, a cylinder being attached to an outer surface of said first plate, said inner surface of said second plate being selectively positionable against said outer surface of said second arm, a second pair of fasteners extending through said second arm and being selectively extendable through said aperture in second plate; and a third L-shaped member having a first rod and a second rod, said first rod having a cylindrical shape and being positioned in and rotatably coupled to said cylinder, said first rod having a free end having a head attached thereto, said head having a larger diameter than said cylinder, a third pair of fasteners extending through said cylinder and being selectively abutted against said first rod, wherein said second rod is selectively extended under the support beam.

6. The assembly according to claim 4, wherein each of said couplers includes:

a first L-shaped member having a first arm and a second arm, each of said first and second arms having an outer surface having a plurality of teeth thereon, said outer surface of said first arm being selectively positionable against said rearward side of one of said vertical arms, a first pair of fasteners extending through said first arm and being selectively extendable through said vertical slot, wherein said second arm is selectively positionable over the support beam;

a second L-shaped member having a first plate and a second plate, said second plate having an inner surface having teeth thereon, said second plate having an elongated aperture therein, a cylinder being attached to an outer surface of said first plate, said inner surface of said second plate being selectively positionable against said outer surface of said second arm, a second pair of fasteners extending through said second arm and being selectively extendable through said aperture in second plate; and a third L-shaped member having a first rod and a second rod, said first rod having a cylindrical shape and being positioned in and rotatably coupled to said cylinder, said first rod having a free end having a head attached thereto, said head having a larger diameter than said cylinder, a third pair of fasteners extending through said cylinder and being selectively abutted against said first rod, wherein said second rod is selectively extended under the support beam.

7. The assembly according to claim 5 further including a pair of tethers, each of said tethers being elongated and having a first end and a second end, each of a pair of loops being attached to one of said first ends, each of said second ends being removably attached to peripheral wall, each of said second ends being positionable adjacent to one of said first and second side edges.

8. The assembly according to claim 1, further including a pair of tethers, each of said tethers being elongated and having a first end and a second end, each of a pair of loops being attached to one of said first ends, each of said second ends being removably attached to peripheral wall, each of said second ends being positionable adjacent to one of said first and second side edges.

9. A tray assembly for releasably mounting on a support beam, said assembly comprising:

a panel having a top side, a bottom side and a peripheral edge, said panel having a generally rectangular shape such that said peripheral edge includes a front edge, a back edge, a first side edge and a second side edge, a peripheral wall being attached to said peripheral edge and extending upwardly away therefrom;

a plurality of magnets being attached to said bottom side of said panel, said magnets being spaced from each other, said plurality of magnets including two magnets;

a pair of brackets, each of said brackets being attached to said panel and being spaced from each other, each of said brackets including a horizontal arm attached to said bottom side and extending from said back edge to said front edge, each of said brackets including a vertical arm being attached to an associated one of said horizontal arms, each of said vertical arms extending upwardly from said back edge, each of said vertical arms having a forward side facing said panel and a rearward side, each of said vertical arms having an elongated vertical slot extending therethrough, each of said rearward sides having a plurality of teeth thereon;

a pair of couplers, each of said couplers being removably attached to one of said vertical arms and being adapted for selectively coupling said vertical arms to the support beam, each of said couplers including:

a first L-shaped member having a first arm and a second arm, each of said first and second arms having an outer surface having a plurality of teeth thereon, said outer surface of said first arm being selectively positionable against said rearward side of one of said vertical arms, a first pair of fasteners extending through said first arm and being selectively extendable through said vertical slot, wherein said second arm is selectively positionable over the support beam;

a second L-shaped member having a first plate and a second plate, said second plate having an inner surface having teeth thereon, said second plate having an elongated aperture therein, a cylinder being attached to an outer surface of said first plate, said inner surface of said second plate being selectively positionable against said outer surface of said second arm, a second pair of fasteners extending through said second arm and being selectively extendable through said aperture in second plate;

a third L-shaped member having a first rod and a second rod, said first rod having a cylindrical shape and being positioned in and rotatably coupled to said cylinder, said first rod having a free end having a head attached thereto, said head having a large diameter than said cylinder, a third pair of fasteners extending through said cylinder and being selectively abutted against said first rod, wherein said second rod is selectively extended under the support beam; and a pair of tethers, each of said tethers being elongated and having a first end and a second end, each of a pair of loops being attached to one of said first ends, each of said second ends being removably attached to peripheral wall, each of said second ends being positionable adjacent to one of said first and second side edges.

* * * * *